US006669819B2

(12) United States Patent
Mausser et al.

(10) Patent No.: US 6,669,819 B2
(45) Date of Patent: Dec. 30, 2003

(54) DEVICE FOR CONTINUOUS REELING OF A PULP SHEET

(75) Inventors: Wilhelm Mausser, Graz (AT); Gerald Schadler, Vasoldsberg (AT)

(73) Assignee: Andritz AG, Graz (AT)

( * ) Notice: Subject to any disclaimer, the term of this patent is extended or adjusted under 35 U.S.C. 154(b) by 1 day.

(21) Appl. No.: 10/047,623

(22) Filed: Jan. 16, 2002

(65) Prior Publication Data

US 2002/0104629 A1 Aug. 8, 2002

(30) Foreign Application Priority Data

Jan. 22, 2001 (AT) ..... 105/2001

(51) Int. Cl.[7] ..... B31C 11/00

(52) U.S. Cl. ..... 162/283; 162/118; 242/547; 242/541.7; 242/541.1; 242/542.3; 242/539

(58) Field of Search ..... 162/118, 283; 242/547, 541.7, 541.1, 542.3, 539

(56) References Cited

U.S. PATENT DOCUMENTS

| | | | | | |
|---|---|---|---|---|---|
| 5,845,868 | A | * | 12/1998 | Klerelid et al. | 242/541 |
| 6,036,137 | A | * | 3/2000 | Myren | 242/541.7 |
| 6,098,510 | A | * | 8/2000 | Hada et al. | 83/13 |
| 6,250,580 | B1 | * | 6/2001 | Madrzak et al. | 242/533.2 |
| 6,427,938 | B1 | * | 8/2002 | Madrzak et al. | 242/526.3 |

* cited by examiner

*Primary Examiner*—Steven P. Griffin
*Assistant Examiner*—M. Halpern
(74) *Attorney, Agent, or Firm*—Alix, Yale & Ristas, LLP

(57) ABSTRACT

A device for continuous reeling of a pulp sheet, particularly a paper sheet, where the sheet runs over a reel drum and is later wound on a horizontal reel with a horizontally adjustable holding device. The horizontally adjustable holding device having support rollers that run in guide units, where the guide units are sealed off by a vertically arranged moving belt.

9 Claims, 5 Drawing Sheets

DEVICE FOR CONTINUOUS REELING OF A PULP SHEET

BACKGROUND OF THE INVENTION

The invention relates to a device for continuous reeling of a pulp sheet, particularly a paper sheet, e.g. tissue, where the sheet runs over a reel drum and is later wound on a horizontal reel, with a horizontally adjustable holding device.

Devices of this kind have been known for some time in the production of paper sheet. The disadvantage of the devices known is that either the contact pressure of the horizontal reel on the reel drum is such that the horizontal reel is driven by the force generated by friction or, if a separate drive is provided for the horizontal reel, the pressing force cannot be set exactly because there are too many points where non-calculable losses arise, e.g. due to friction. The pressure pre-set at the contact pressure cylinders thus does not define the actual pressing force between reel drum and horizontal reel. Low pressing force is desirable in particular for tissue with a high volume in order to avoid destroying the high volume again with the contact pressure. In the conventional devices known to date, however, the pressing force can only be set imprecisely and the losses due to friction in the mechanical parts already exceed the required contact pressure, thus it is impossible to control the pressing force exactly. In the plants known to date the guide units also become clogged, which leads to jerky movements, among other things, and thus to a flawed paper sheet.

SUMMARY OF THE INVENTION

The aim of the invention is to permit the core shaft (horizontal reel) to move uniformly in horizontal direction.

The invention is thus characterized by the horizontally adjustable holding device being provided with support rollers that run in guide units, where the guide units are sealed off by a vertically arranged moving belt. This prevents clogging in the guide units, as well as the jerky movement by the holding device that this causes.

An advantageous further development of the invention is characterized by the vertically arranged moving belt being a continuous loop running round two deflection rolls provided at the ends of the guide units. This reduces the friction losses to a minimum.

A favorable further development of the invention is characterized by the endless belt being made of woven fabric, synthetic material or steel. In this way, the most favorable solution can be sought in each case.

A favorable further development of the invention is characterized by the deflection rolls having trapezoidal grooves to guide the belt, with the endless-woven belt at least having a trapezoidal guide profile that meshes into the trapezoidal grooves in the deflection rolls. This permits very good belt guiding and prevents the belt from running off track to the side.

An advantageous further development of the invention is characterized by slots that enclose the belt edges being provided to guide the belt. This also provides a good seal.

A favorable configuration of the invention is characterized by the void between guide unit and belt being suitable for injecting compressed air. Thus, it is possible to keep even the smallest dust particles out.

A favorable further development of the invention is characterized by the holding device having a load-sensing unit. Thus, the pressing force of the core shaft on the reel drum can be measured directly and precisely.

An advantageous configuration of the invention is characterized by the adjustable holding device being connected to pressure cylinders, particularly hydraulic cylinders, where the pressure cylinders are connected to a regulating and/or control device. Thus, exact and continuous movement by the holding device is always guaranteed, and the pressing force can be maintained at a constant level as a result.

BRIEF DESCRIPTION OF THE DRAWINGS

The invention will now be described in examples and referring to the drawings, where.

DETAILED DESCRIPTION OF THE PREFERRED EMBODIMENT

Figure 1:
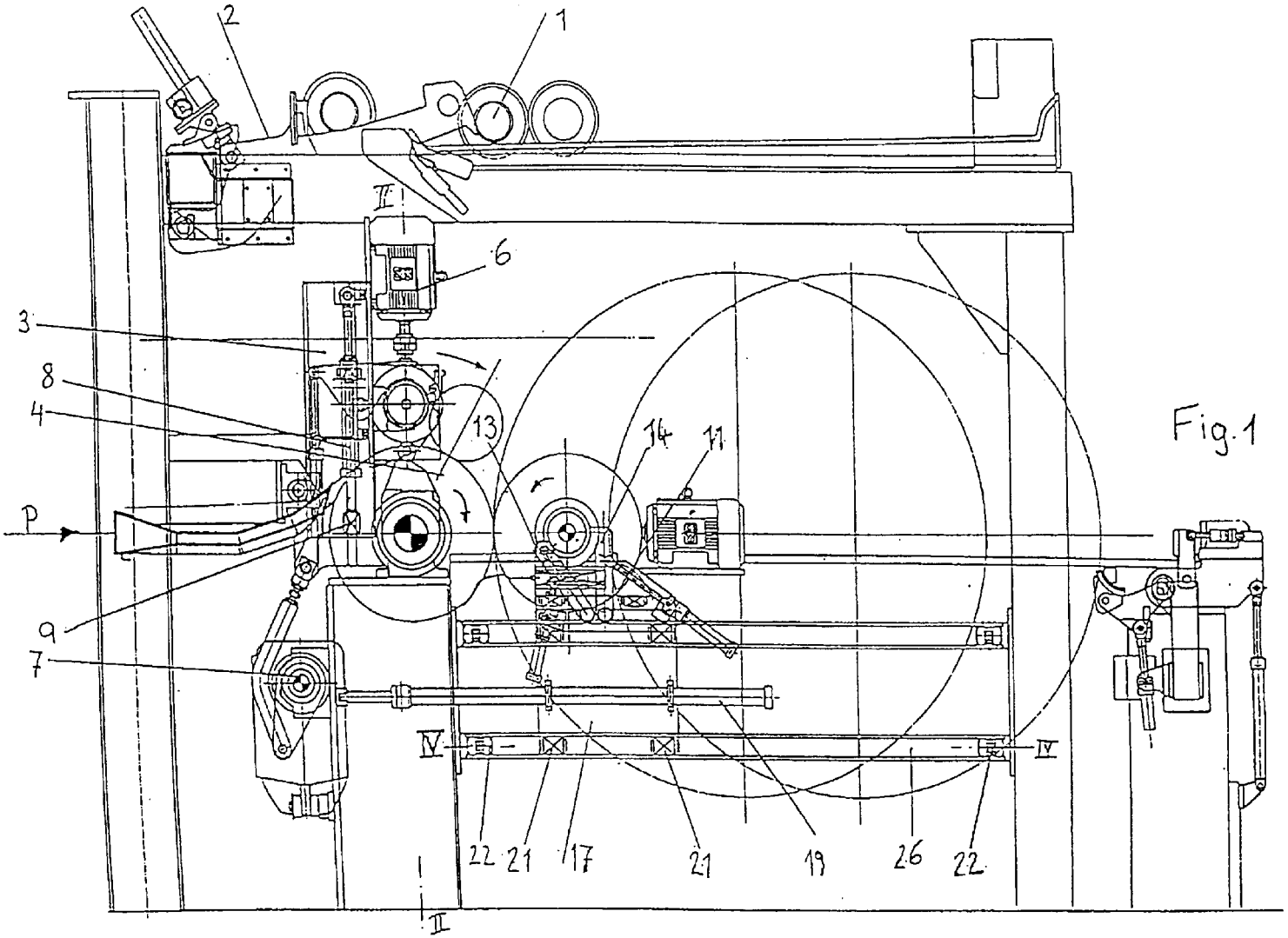
FIG. 1 shows a plant according to the invention.

The action of the device will now be described with the help of FIG. 1. The core shaft (horizontal reel) 1 is placed in the primary arm 3 using a lowering device 2 and clamped in place hydraulically in a vertical position above the reel drum 4. On the front side, FS, there is a gear motor 6 installed on a mounting plate and which is movable in axial direction. This motor is coupled to the core shaft 1 to bring the shaft up to machine speed.

A swivelling device 7 now turns the primary arm 3 round the axis of the reel drum 4 until the core shaft 1 is resting on the drum. During this process the core shaft 1 takes hold of the paper web P over its entire width with the aid of a suitable device and begins winding it on, thus increasing its diameter. The pressing force needed between the core shaft 1 and the reel drum 4 is applied and controlled via hydraulic cylinders 8, which are fitted with a load-sensing device. Here, compensation of the weight of the core shaft 1 is also taken into account. The primary arm 3 is now swivelled further round the axis of the reel drum 4 until the core shaft 1 reaches a horizontal position. At the same time, the thickness of the paper roll increases continuously up to a maximum of 350 mm. During this process, the outer part of the primary arm 3 moves outward telescopically. This arm runs on roller bearings 9 in order to keep the influence of friction on the nip force as low as possible. The paper roll is placed on a horizontally movable holding device 11 and clamped in.

Figure 2:
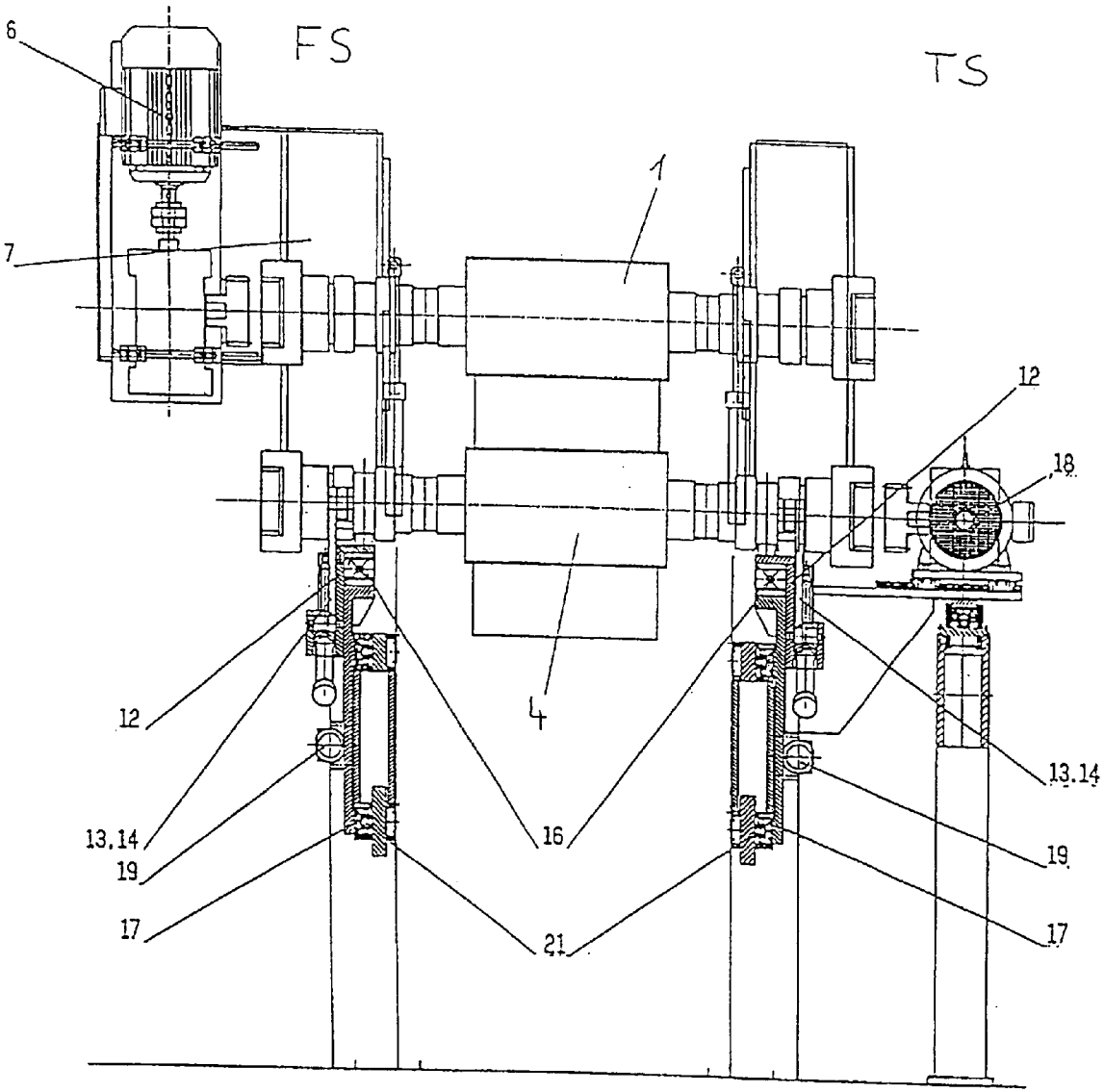
FIG. 2 shows a sectional view taken along the line II—II in FIG. 1, FIG. 3 contains an extract from FIG. 1.
Figure 3:
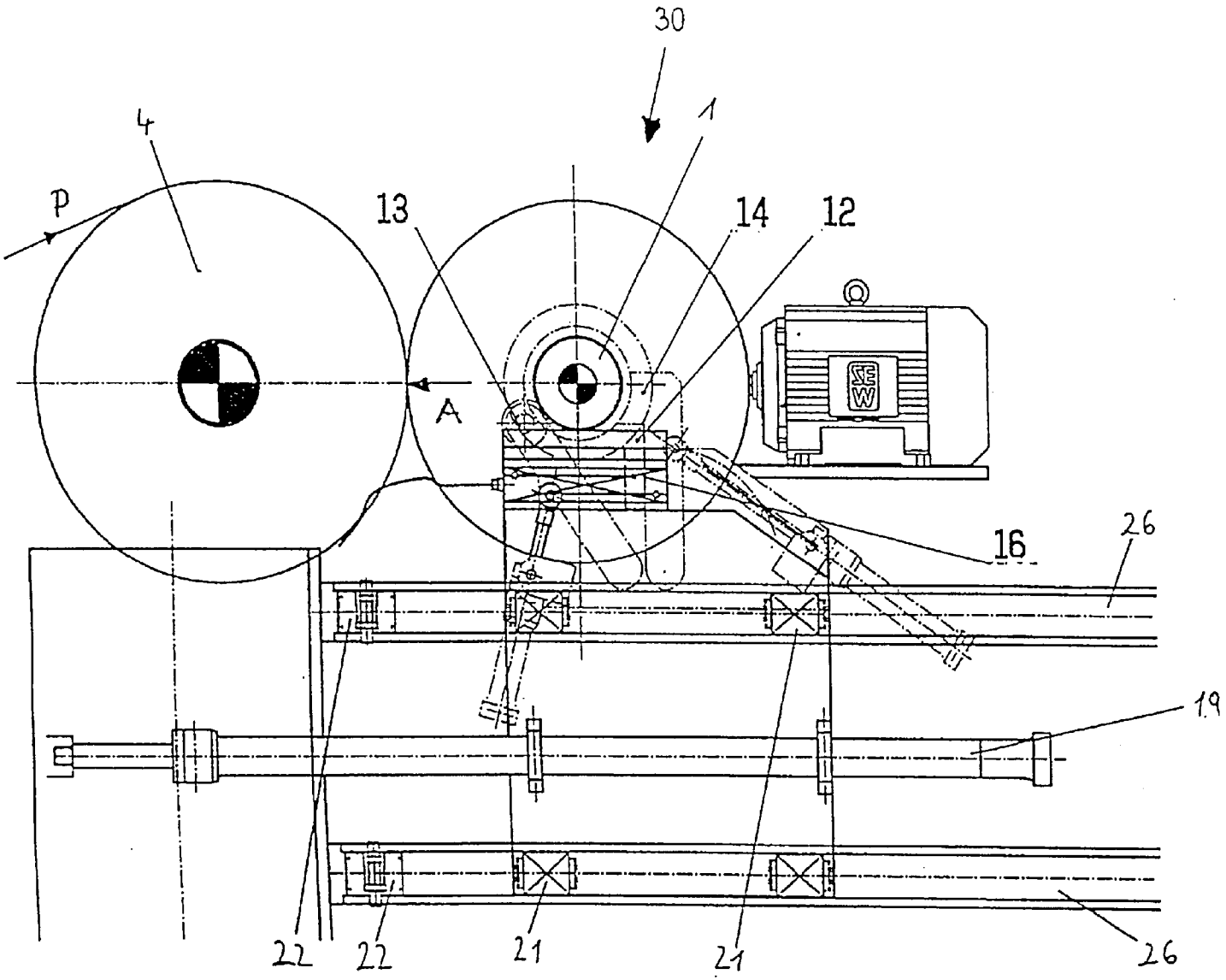

FIG. 2 shows a sectional view taken along the line II—II in FIG. 1. The holding device 11 comprises a receiving part 12 with two hydraulically operated clamping levers 13, 14 and rests on a load-sensing device 16, which again is mounted on the movable part 17. The entire unit is also referred to as the secondary arm 30 (FIG. 3). On the rear side TS, a gear motor 18 that is movable in axial direction is connected to the holding device 11. As soon as the paper roll is horizontal, this drive 18 on the rear side TS is connected to the core shaft 1 and the drive 6 in the primary arm 3 is disconnected. In the further winding process the horizontal nip force (pressing force between horizontal reel 1 and reel drum 4) is generated via the secondary arm 30 with one hydraulic cylinder 19 on both the front side FS and rear side TS and is controlled using a load-sensing device.

As the winding process continues in the secondary arm 30, the next core shaft 1 is prepared in the primary arm 3. As soon as the paper reel has obtained the desired size, it is pulled away from the reel drum 4, the new core shaft 1 in the primary arm 3 is placed in the initial winding position on the reel drum 4 and the full width of the paper web P is now wound onto this new core shaft. When the finished paper roll has been ejected from the secondary arm 30, this arm moves back to the reel drum 4 and then receives the new core shaft 1 from the primary arm 3. The load-sensing devices 16 are designed such that they only measure the horizontal forces actually applied in the nip between the horizontal reel 1 and the reel drum 4. Vertical components from the drives or from the changing own weight of the paper roll do not influence the values measured. The measured value signals recorded control the movement of the two hydraulic cylinders 19 in order to ensure that the secondary arms 30 are running absolutely parallel on the front FS and rear TS sides, and to guarantee a pre-selected nip force progression (constant or changing) throughout the entire winding process. The moving part 17 of the secondary arm 30 is supported on horizontally moving rollers 21 in order to keep the influence of friction low here as well.

FIG. 3 now shows an extract from FIG. 1, showing the secondary arm 30. Here it is possible to make out reel drum 4 and core shaft 1 with a partially wound paper roll. The pressing force A can be measured via load-sensing device 16 without losses and regardless of the position because there are no intermediate elements to cause losses. During the winding process, the movable part 17 of the secondary arm 30 is displaced by the hydraulic cylinders 19 in such a way that the pressing force A of the core shaft 1 acting on the reel drum 4 is always the same. The respective position of the secondary arm 30 is recorded here by measuring systems integrated into the cylinders 19.

In order to avoid destroying the volume of the paper web P, very low pressing forces (down to a minimum of approx. 0.1 N/mm) are applied. The movable part 17 can be displaced with very low friction losses using the support rollers 21.

Figure 4:
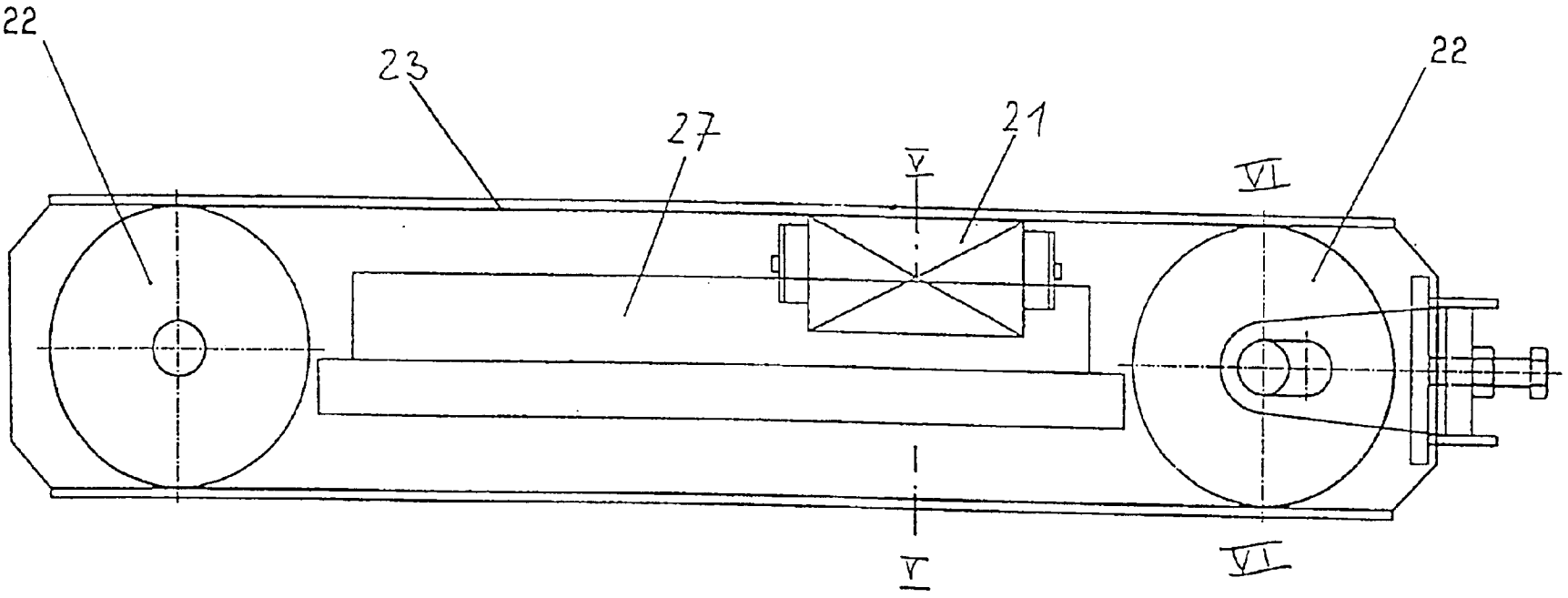
FIG. 4 is a sectional view taken along the line IV—IV in FIG. 1.

These support rollers 21 are protected against dirt accumulations by a special device, which is shown in FIG. 4 (sectional view taken along the line IV—IV in FIG. 1). It consists of two deflection rolls 22 per guide unit 26 (8 deflection rolls in total for one plant), where each deflection roll 22 has a vertically extending axis and one roll 22 can be tensioned. An endless woven belt 23 made of fabric, plastic or steel runs longitudinally around the deflection rolls 22. The support rollers 21 are secured to this belt 23, however only one support roller 21 is shown here as an example.

Figures 5, 6, 7:
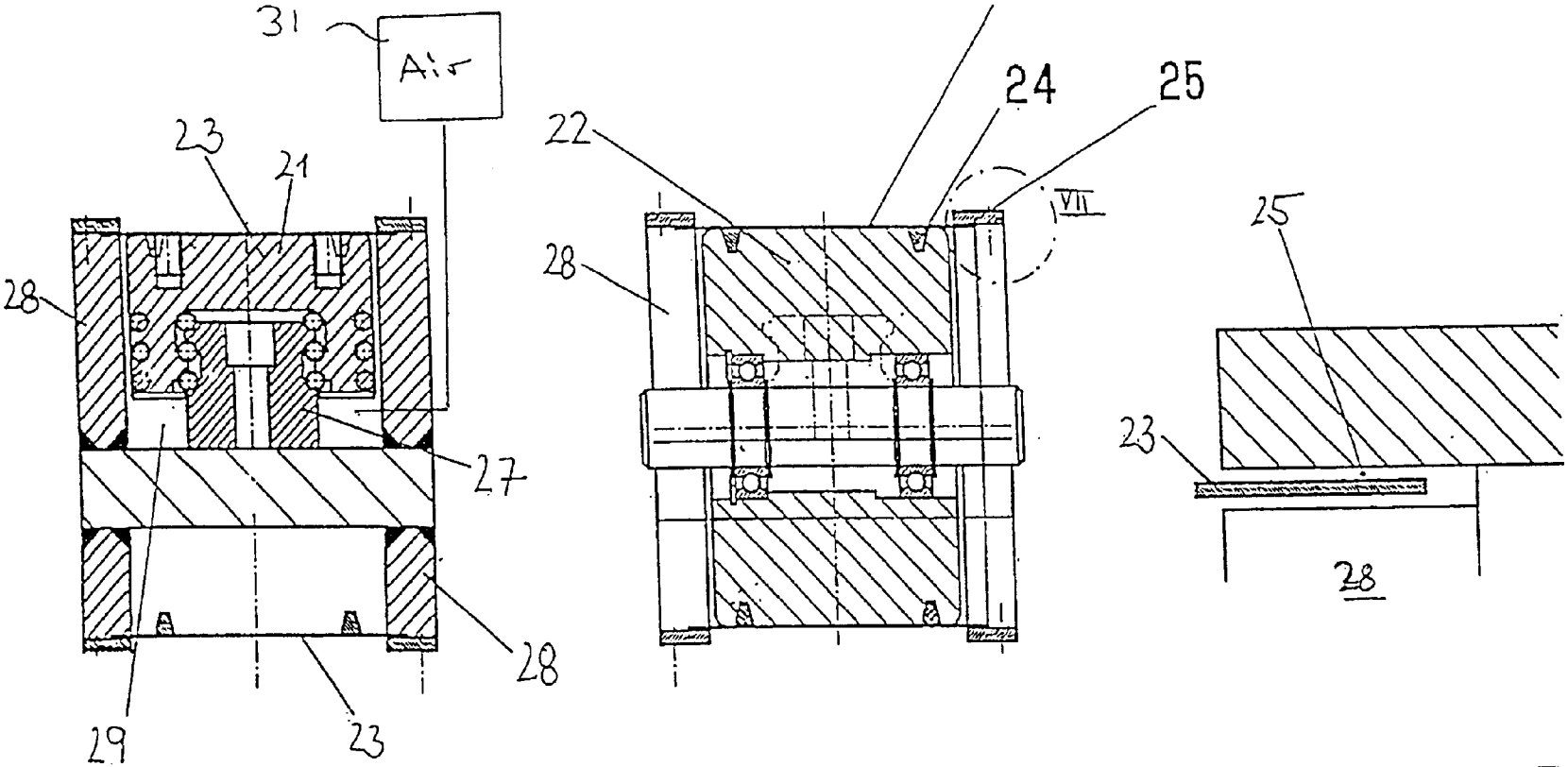
FIG. 5 is a sectional view taken along the line V—V in FIG. 4.
FIG. 6 is a sectional view taken along the line VI—VI in FIG. 4.
FIG. 7 is an extract as encircled in VII in FIG. 6.

FIG. 5 now shows a sectional view taken along the line V—V in FIG. 4, where the structure of the support rollers 21 is visible. The support rollers 21 run here on rails 27. The surfaces 28 of the guide unit 26 are visible on the top and underside. This illustration also shows the vertically arranged endless woven belt 23, to which the support rollers 21 are attached and which also moves along close to the wall surfaces 28 of the guide unit 26 on the other side. In addition, the void 29 created by this device is protected against dust entering by the constant supply of compressed air blown in from an air source 31.

FIG. 6 shows a sectional view taken along the line VI—VI in FIG. 4, which runs through a deflection roll 22. The deflection rolls 22 have two trapezoidal grooves, for example, with two trapezoidal guide profiles 24 also being provided on the endless woven belt 23, for example, which mesh into the grooves in the deflection rolls 22 and thus, prevent the belt from running off track to the side. The number of grooves may vary depending on the belt width.

FIG. 7 shows an extract VII from FIG. 6. This illustration clearly shows lateral slots 25 in the wall 28 of the guide unit 26, which are used to guide the belts 23 and as seals.

What is claimed is:

1. Apparatus for continuously reeling a pulp sheet, comprising:

a horizontal reel adapted for having the pulp sheet wound thereon;

a reel drum adapted for pressing the pulp sheet onto the horizontal reel;

a horizontally adjustable holding device including a plurality of guide units, each guide unit extending horizontally from a first end to a second end, at least one support roller disposed within each guide unit, the support roller being adapted for supporting the horizontal reel and pulp sheet wound thereon, first and second deflection rolls rotatably mounted at the first and second ends of each guide unit, each of the deflection rolls having a vertical axis, and a plurality of vertically arranged endless belts one of the endless belts rotatably running around the first and second deflection rolls of each guide unit;

wherein each guide unit is sealed by the associated endless belt.

2. Apparatus according to claim 1 wherein the endless belt is composed of woven fabric, synthetic material or steel.

3. Apparatus according to claim 1 wherein for at least one guide unit, the associated first and second deflection rolls each define at least one circumferential trapezoidal groove and the associated endless belt has a longitudinally extending trapezoidal guide profile that is received in the trapezoidal grooves of the deflection rolls.

4. Apparatus according to claim 1 wherein each of the endless belts has oppositely disposed edges and each of the guide units has a wall defining a pair of slots, one of the slots enclosing each of the belt edges, whereby the guide unit guides the belt.

5. Apparatus according to claim 1 further comprising a source of compressed air and wherein the guide unit has an inner surface, the inner surface of the guide unit and the associated support roller defining a void in fluid communication with the source of compressed air.

6. Apparatus according to claim 1 wherein the holding device also includes a load-sensing unit.

7. Apparatus according to claim 1 wherein the holding device also includes at least one pressure cylinder.

8. Apparatus according to claim 7 wherein the holding device further includes a control device, the pressure cylinders being connected to the control device.

9. Apparatus according to claim 7 wherein the pressure cylinders are hydraulic cylinders.

* * * * *